US005682813A

United States Patent [19]

Brewer et al.

[11] Patent Number: 5,682,813

[45] Date of Patent: Nov. 4, 1997

[54] PRESS SHUTHEIGHT CONTROL THROUGH HYDRAULIC PRESSURE

[75] Inventors: W. Craig Brewer, Minster; Edward Daniel, Fort Loramie, both of Ohio

[73] Assignee: The Minster Machine Company, Minster, Ohio

[21] Appl. No.: 622,955

[22] Filed: Mar. 27, 1996

[51] Int. Cl.[6] ..... B30B 15/00

[52] U.S. Cl. ..... 100/257; 72/446; 83/530

[58] Field of Search ..... 100/257, 282; 72/446; 83/527, 530, 640

[56] References Cited

U.S. PATENT DOCUMENTS

| | | | |
|---|---|---|---|
| 3,005,404 | 10/1961 | Tucker, Sr. . | |
| 3,178,983 | 4/1965 | Brunson | 83/530 |
| 3,298,267 | 1/1967 | Schmid et al. . | |
| 3,892,143 | 7/1975 | Kleister et al. . | |
| 3,967,483 | 7/1976 | Kuroyahagi et al. . | |
| 4,033,252 | 7/1977 | Baker . | |
| 4,103,611 | 8/1978 | Carlsson . | |
| 4,135,446 | 1/1979 | Bareis et al. | 83/530 |
| 4,148,209 | 4/1979 | Bessho . | |
| 4,282,738 | 8/1981 | Kojima et al. . | |
| 4,289,066 | 9/1981 | Proga | 100/257 |
| 4,790,173 | 12/1988 | Boutcher, Jr. . | |
| 4,823,687 | 4/1989 | Yonezawa et al. | 100/257 |
| 5,140,834 | 8/1992 | Kashiwagi et al. . | |
| 5,205,149 | 4/1993 | Hayashi . | |
| 5,349,902 | 9/1994 | Daniel et al. | 83/530 |
| 5,445,072 | 8/1995 | Yagi et al. | 72/446 |
| 5,493,959 | 2/1996 | Yagi et al. | 83/530 |

FOREIGN PATENT DOCUMENTS

| | | | |
|---|---|---|---|
| 46-39755 | 11/1971 | Japan | 100/257 |

*Primary Examiner*—Stephen F. Gerrity
*Attorney, Agent, or Firm*—Randall J. Knuth

[57] ABSTRACT

A mechanical press having a very precise shutheight control system. The press includes a bed connected to a frame with a slide connected with the frame for reciprocating motion opposing the bed. The slide and bed together define a shutheight of the press. A drive mechanism is attached to the frame for driving the reciprocating slide, the drive mechanism includes a drive piston and a tie rod. The shutheight control system includes a chamber located between the drive piston and tie rod with a pressurizing mechanism in communication with the chamber for selectively pressurizing the chamber with a predetermined pressure. The pressurizing mechanism causes the tie rod to one of expand and contract to thereby control press shutheight.

6 Claims, 3 Drawing Sheets

PRESS SHUTHEIGHT CONTROL THROUGH HYDRAULIC PRESSURE

BACKGROUND OF THE INVENTION

1. Field of the Invention

The present invention relates to mechanical presses, and, more particularly, to shutheight adjustment while the press is operating.

2. Description of the Related Art

Mechanical presses, for example, stamping presses and drawing presses, comprise a frame having a crown and bed and a slide supported within the frame for motion toward and away from the bed. The slide is driven by a crankshaft having a connecting arm connected to the slide.

Such mechanical presses are widely used for stamping and drawing operations and vary substantially in size and available tonnage depending upon the intended use.

In conventional presses of this type, the slide is generally connected to the crankshaft by a connecting rod which is adjustable in length or which is connected to another member, such as a connection screw, that is adjustable in its relation to the slide so that the shutheight opening between the slide and the bed can be adjusted to accommodate various die sets. Alternatively, the bed portion or bolster of the press may have its position adjusted relative to the slide so as to adjust the shutheight therebetween, as disclosed in U.S. Pat. No. 3,858,432. Regardless of the mode of shutheight adjustment, the slide is generally guided on the uprights of the press frame extending between the crown and the bed so that the parts of the die set remain in accurate registration as the slide reciprocates.

SUMMARY OF THE INVENTION

The present invention is directed to improve upon the aforementioned mechanical press shutheight adjustment mechanisms wherein it is desired to increase the accuracy of shutheight control.

The present invention provides a shutheight control system which includes a pressurizing means in communication with a chamber located on the press slide for selectively pressurizing the chamber with a predetermined pressure of, for instance, hydraulic oil. The pressurizing means causes the slide hold down bolt or tie rod to lengthen or contract, thereby controlling the shutheight.

The invention, in one form thereof, comprises a mechanical press including a frame and bed connected together with a slide connected with the frame for reciprocating motion opposing the bed. The slide and bed define a shutheight of the press when the slide is at bottom dead center. A drive mechanism is attached to the frame for driving the slide and includes a drive piston and a tie rod. A shutheight control system is utilized having a chamber located between the piston and the tie rod. The shutheight control system further includes a pressurizing means in communication with the chamber for selectively pressurizing the chamber with a predetermined pressure. The pressurizing means causes the tie rod to one of expand and contract to thereby control shutheight.

The invention in another form thereof, includes a press shutheight control system having a drive piston and a tie rod connected to the drive piston on one end, with the other end having a flange. A sleeve surrounds the tie rod and engages the flange forming an enclosed space with the drive piston. A pressurizing means is connected to the drive piston for variably pressurizing the enclosed space whereby the length of the tie rod is changed by varying the pressure within the enclosed space.

The invention, in yet another form thereof, includes a method of changing press shutheight on a press, the method comprises the steps of providing a drive piston connected to a tie rod, providing a sleeve adjacent said tie rod in which the sleeve in contact with the drive piston and the tie rod. The sleeve and drive piston form a chamber therebetween. The last step of the method is that of pressurizing the chamber to elongate the tie rod whereby press shutheight is changed.

An advantage of the shutheight mechanism of the present invention is that the hydraulic oil trapped within the pressurized chamber helps reduce punch penetration resulting in a dynamically stiffer press die set, thereby correspondingly increasing die life. By more accurately controlling shutheight, accidental impacts between the dies are reduced.

A further advantage of the present invention is that preloading of the tie rod permits both extension and contraction for press shutheight control.

A further advantage of the present invention is that there are no moving parts as compared to prior mechanisms for dynamically changing shutheight. Hydraulic pressure is utilized to expand or contract a tie rod connected to a standard shutheight mechanism, thereby creating a more reliable control system at a lower cost.

Yet a further advantage of the present invention is that by utilization of hydraulic pressure, very minute changes of shutheight may be accurately controlled.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Figure 1:
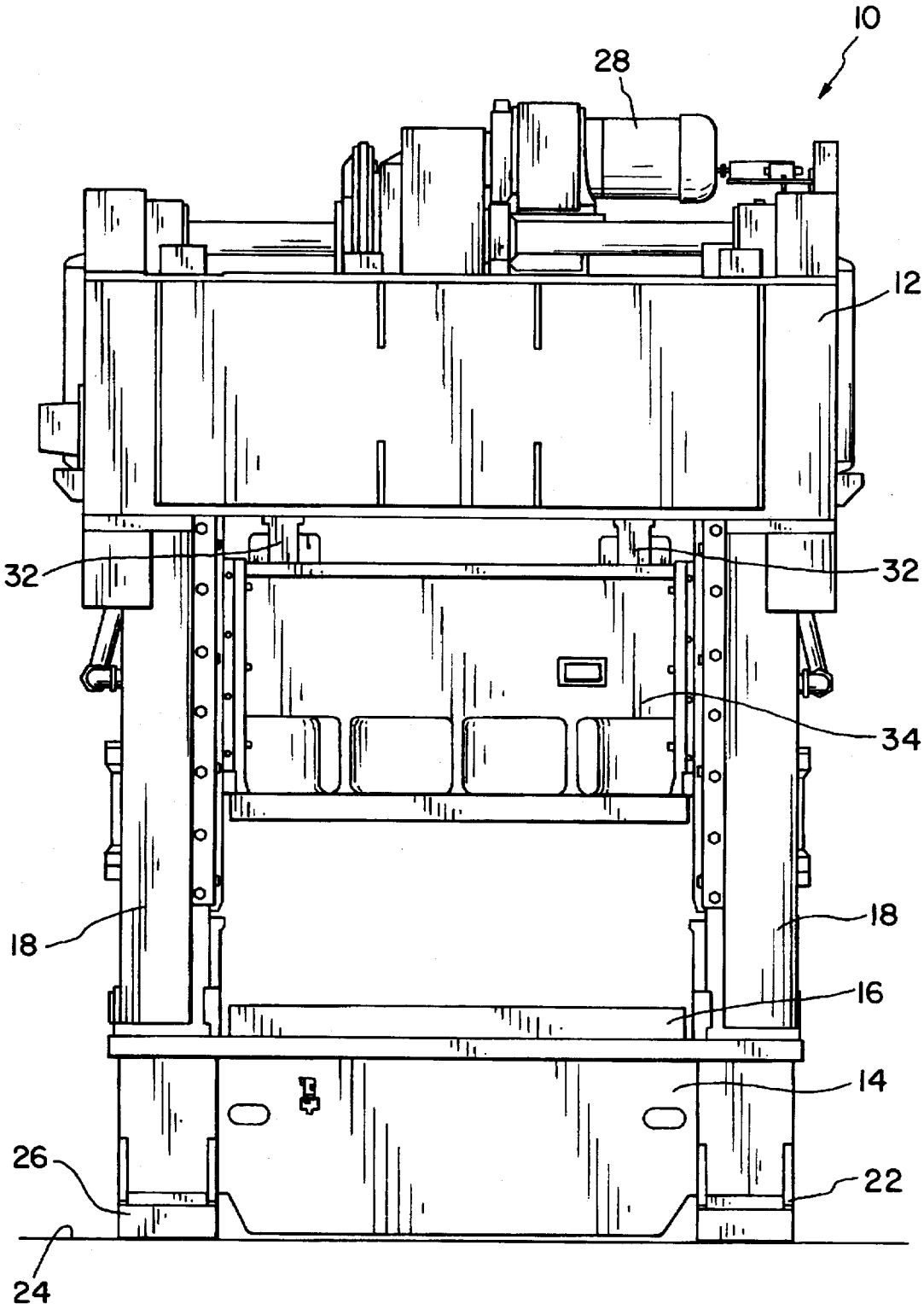
FIG. 1 is an elevational view of a mechanical press incorporating the shutheight adjustment system of the present invention.

Corresponding reference characters indicate corresponding parts throughout the several views. The exemplifications set out herein illustrates one preferred embodiment of the invention, in one form, and such exemplifications are not to be construed as limiting the scope of the invention in any manner.

DETAILED DESCRIPTION OF THE INVENTION

Referring now to FIG. 1, mechanical press 10 comprises a crown portion 12, a bed portion 14 having a bolster assembly 16 connected thereto and uprights 18 connecting crown portion 12 with bed portion 14. Uprights 18 are connected to or integral with the underside of crown 12 and the upper side of bed 14. Tie rods (not shown) extend through crown 12, uprights 18 and bed portion 14 and are attached on each end with tie rod nuts (not shown). Leg members 22 are formed as an extension of bed 14 and are generally mounted on the shop floor 24 by means of shock absorbing pads 26.

A drive mechanism, such as a press drive motor 28, is attached to crown 12 of the press and connected by a clutch/brake mechanism (not shown) to a crankshaft (also not shown) to which connecting rods 32 are attached. A slide 20 (FIGS. 2 and 3) is operatively connected to slide pistons 34 via connecting rods 32. During operation, drive motor 28 rotates the crankshaft which operates eccentrically connected connecting rods 32 to cause slide 20 to reciprocate in rectilinear fashion toward and away from bed 14.

Figure 2:
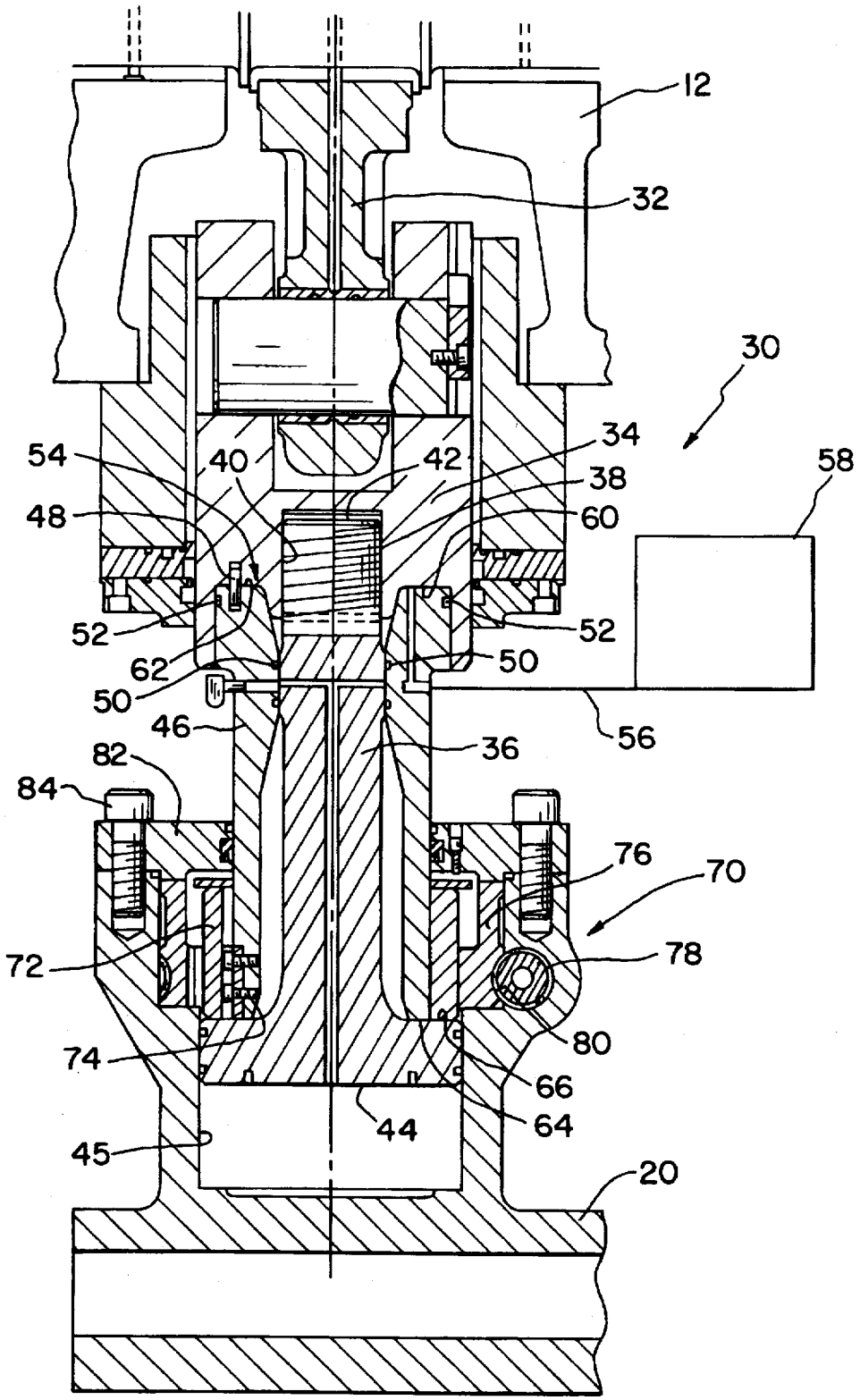
FIG. 2 is an enlarged fragmentary sectional view of one form of the invention.

FIG. 2 illustrates hydraulic shutheight mechanism 30, which is one embodiment of the present invention.

A slide piston 34 is connected to connecting rod 32. A tie rod 36 is attached to slide piston 34 such as by the engagement of external threads 38 on tie rod 36 with internal threads 40 within slide piston 34. Tie rod 36 includes a first end 42 and a second end 44, the second end 44 being disposed in a chamber 45 within slide 20.

As is shown in FIG. 2, a sleeve 46 is disposed and retained around tie rod 36. A pin member 48 is used to prevent relative rotation between sleeve 46 and slide piston 34 (FIG. 2). Additionally, seals 50 and 52 are located at an interface between sleeve 46 and tie rod 36, and sleeve 46 and slide piston 34, respectively. The space at this interface forms a stretch chamber 54 which is in fluid communication by a hydraulic line 56 to a source 58 of hydraulic pressure. Hydraulic pressure source 58 is used to pressurize chamber 54.

Many types of hydraulic pressurizing controls may be utilized as a source of hydraulic pressure, such as hydraulic pumps, manifolds and hydraulic valves. As hydraulic pressure is applied to or removed from stretch chamber 54, the distance between second end 44 of tie rod 36 and slide piston either expands or contracts because of the lengthening or shortening of tie rod 36.

The length of tie rod 36 is changed by action of the sleeve 46 bottom edge 64 which engages a surface 66 of tie rod 36. More specifically, as hydraulic pressure fills stretch chamber 54, (i.e. the space between a bottom surface 60 of slide piston 34 and a top portion 62 of sleeve 46) sleeve 36 forces tie rod second end 44 away from first end 42, thereby tie rod 36 is stretched. Conversely, when the pressure is reduced after such pressure has been previously applied, tie rod 36 shrinks back to its length before such pressure was applied.

A coarse shutheight adjustment mechanism 70 is also included in press 10. Sleeve 46 is attached to an adjustment screw 72 by an anti-rotation key 74. A worm adjustment shaft engages external threads along an outer flange 80 of adjustment nut 76. The entire adjustment nut assembly is covered by adjustment nut cover 82 that is fixably attached to slide 20 by fasteners such as metal screws 84. This ensures that the entire coarse shutheight adjustment mechanism 70 may be sealed to prevent entry of debris and exit of hydraulic fluid. At times it may be desired to pressurize this adjustment screw assembly 70 located beneath cover 82 to thereby reduce the torque requirements needed for large scale, coarse shutheight adjustment. Shutheight adjustment mechanism 70 operates in a conventional fashion.

Figure 3:
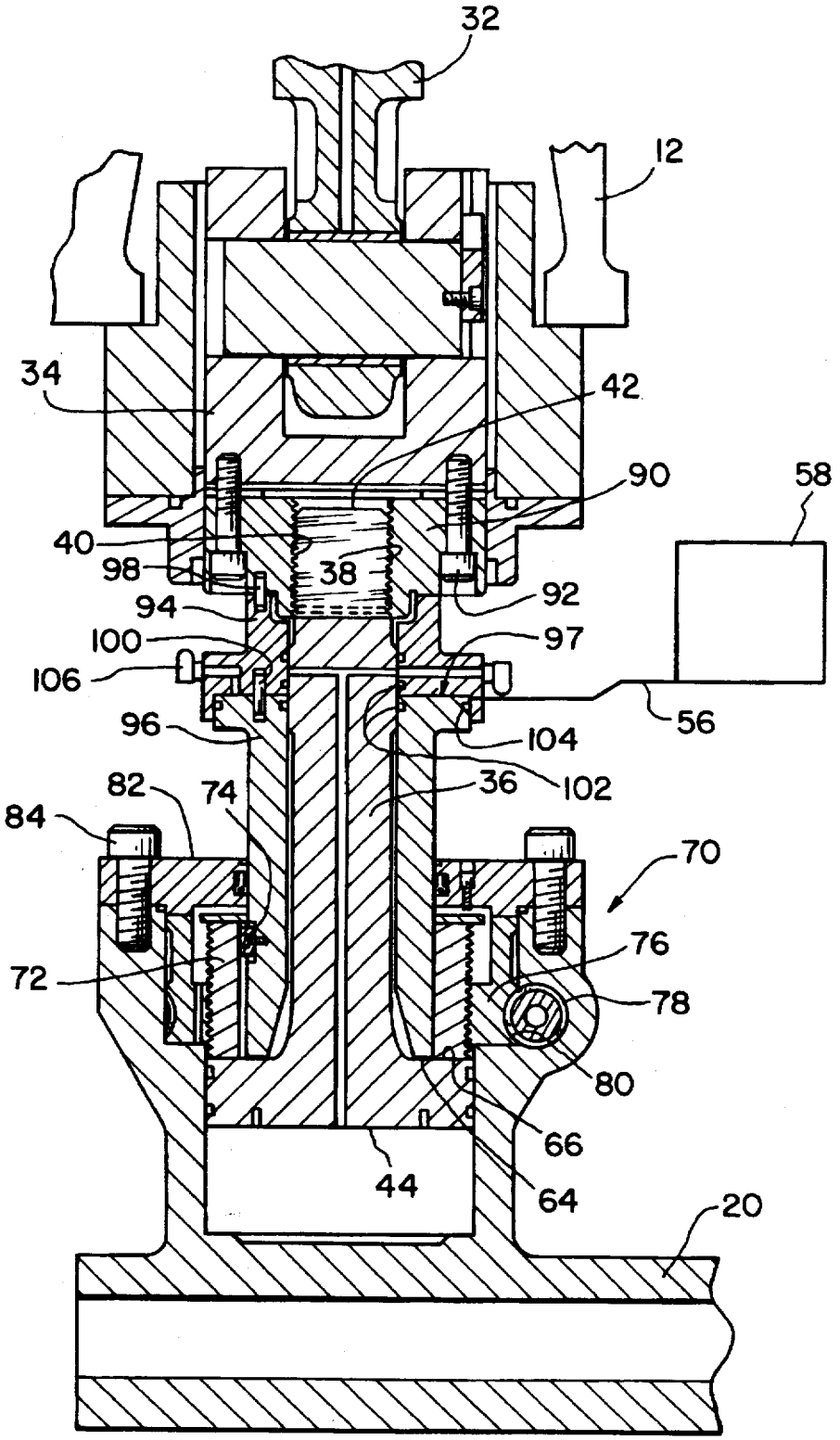
FIG. 3 is an enlarged fragmentary sectional view of another form of the invention.

In the embodiment of FIG. 3, sleeve 46 is split into a top portion 94 and a bottom portion 96 similarly disposed about tie rod 36. At the interface between top portion 94 and bottom portion 96 is created a stretch chamber 97 similar to previous stretch chamber 54. Sleeve top portion 94 and bottom portion 96 are attached and retained by means of tie rod 36. Pins 98, 100 prevent relative rotation between bolt-on member 90, sleeve top portion 94, and sleeve bottom portion 96. Seals 102 between tie rod 36 and both sleeve top portion 94 and sleeve bottom portion 96 seal the interior portion of stretch chamber 97. An annular seal 104 is disposed between sleeve top portion 94 and sleeve bottom portion 96 to seal the radially outward portion of stretch chamber 97. If needed, stretch chamber 97 may be provided with a bleeder 106 to permit release of entrapped air. Similarly, as shown, a source of hydraulic pressure 58 is connected by a line 56 to stretch chamber 97 disposed between sleeve portions 94 and 96.

During press operation, a controller, operator or other mechanism may cause a change of predetermined pressure communicated from hydraulic pressure source 58 through line 56 into a particular stretch chamber 54, 97. The pressure within chamber 54, 97 causes tie rod 36 to either expand or contract due to the applied pressure. This expansion or contraction of tie rod 36 attached to both the slide piston 34 and adjustment screw 72 will therefore cause a change in the position of slide 20 and the effective press shutheight.

The pressures utilized with stretch chamber 54, 97 are approximately between 2000 to 5000 pounds per square inch although these measurements depend on the physical dimensions of the press. A pressure of approximately 3000 pounds per square inch will normally be sufficient for most press uses.

By changing the pressure applied to stretch chamber 54, 97, it is possible to control press shutheight to compensate for press size changes due to temperature and inertia encountered during press operation.

Additionally, it is possible to pre-lengthen tie rod 36 so that during press operation, if temperature and inertia tend to lengthen the stroke of slide 20, by reducing the pre-applied pressure to stretch chamber 54, 97, tie rod 36 may then be permitted to contract so as to maintain press shutheight constant, independent of temperature and inertia forces.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A mechanical press comprising:

a frame;

a bed connected to said frame;

a slide connected with said frame for reciprocating motion opposing said bed, said slide and said bed defining a shutheight of said press when said slide is at bottom dead center;

a drive mechanism attached to said frame for driving said reciprocating slide, said drive mechanism including a drive piston and a tie rod; and a shutheight control system having a chamber located between said piston and said tie rod, said shutheight control system further including a pressurizing means in communication with said chamber for selectively pressurizing said chamber with a predetermined pressure, said pressurizing means causing said tie rod to one of expand and contract to thereby control shutheight.

2. The press of claim 1 in which said pressurizing means pressurizes said chamber to between 2000 to 5000 pounds per square inch.

3. The press of claim 1 in which said pressurizing means pressurizes said chamber to approximately 3000 pounds per square inch.

4. The press of claim 1 in which said pressurizing means comprises a hydraulic pump.

5. The press of claim 4 in which said hydraulic pump varies the applied pressure to said chamber.

6. The press of claim 1 in which said expanding and contracting of said tie rod occurs in an axial direction of said tie rod.

* * * * *